US005263311A

United States Patent [19]

Feil et al.

[11] Patent Number: 5,263,311

[45] Date of Patent: Nov. 23, 1993

[54] METHOD AND APPARATUS FOR MODIFYING SPUN TEXTILE YARN

[75] Inventors: Ralph W. Feil, Charlottesville; Thomas M. Ellis, Earlysville, both of Va.

[73] Assignee: Institute of Textile technology, Charlottesville, Va.

[21] Appl. No.: 689,734

[22] Filed: Apr. 24, 1991

Related U.S. Application Data

[63] Continuation of Ser. No. 545,662, Jul. 2, 1990, abandoned, which is a continuation of Ser. No. 404,616, Sep. 8, 1989, abandoned.

[51] Int. Cl.[5] ..... D01H 7/92

[52] U.S. Cl. ..... 57/333

[58] Field of Search ..... 57/309, 328, 333, 350; 28/271, 219, 220; 242/159

[56] References Cited

U.S. PATENT DOCUMENTS

| | | | |
|---|---|---|---|
| 3,279,164 | 10/1966 | Breen et al. . | |
| 3,826,075 | 7/1974 | Maruyama et al. | 57/333 X |
| 4,107,911 | 8/1978 | Yamana et al. . | |
| 4,112,658 | 9/1978 | Morihashi | 57/350 X |
| 4,399,648 | 8/1983 | Kato . | |
| 4,457,130 | 7/1984 | Sakai et al. | 57/328 |
| 4,497,167 | 2/1985 | Nakahara et al. . | |
| 4,642,978 | 2/1987 | Noda | 57/328 |
| 4,642,981 | 2/1987 | Shimano | 57/333 X |
| 4,674,274 | 6/1987 | Kato . | |
| 4,700,538 | 10/1987 | Varga et al. | 57/328 X |
| 4,768,336 | 9/1988 | Stahlecker et al. | 57/328 |
| 4,768,337 | 9/1988 | Stahlecker et al. | 57/328 |
| 4,858,288 | 8/1989 | Hodgin et al. | 28/219 X |

FOREIGN PATENT DOCUMENTS

| | | | |
|---|---|---|---|
| 52-114742 | 9/1977 | Japan . | |
| 6929 | 1/1979 | Japan | 57/328 |
| 60-126330 | 7/1985 | Japan . | |
| 35294 | 8/1986 | Japan | 57/309 |
| 37372 | 8/1986 | Japan | 57/309 |

OTHER PUBLICATIONS

Murata Publication No. 802MJS.

Toray Publication No. AJS-102.

*Primary Examiner*—Joseph J. Hail, III

*Attorney, Agent, or Firm*—Luke J. Wilburn, Jr.

[57] ABSTRACT

A method of modifying surface characteristics, such as hairiness, and trash content by passing a spun yarn through an air jet nozzle. Data show reduced hairiness and improved cleanliness over normally wound yarn.

10 Claims, 4 Drawing Sheets

METHOD AND APPARATUS FOR MODIFYING SPUN TEXTILE YARN

This application is a continuation of application Ser. No. 07/545,662 filed Jul. 2, 1990 now abandoned, which is a continuation of application Ser. No. 07/404,616, filed Sep. 8, 1989, now abandoned.

BACKGROUND OF THE INVENTION

This invention relates to a method and apparatus for changing the surface characteristics of a spun textile yarn. More particularly, this invention relates to a method and apparatus for suppressing the hairiness of such yarn while removing loose fiber and contamination. Still more particularly, this invention relates to a method and apparatus for producing desired surface characteristics using a suitable air jet nozzle. Still more particularly, this invention relates to a new use for existing air jet nozzles to alter the physical characteristics of the surface of previously-spun yarn and to control the hairiness of such yarn.

In the textile arts, significant attention has been paid to consideration of the effect of yarn hairiness and its impact on weaving performance. It is a general objective in the art to control the final hairiness of the warp yarn so that yarns in the sheet will separate cleanly and easily. Unfortunately, excessive warp yarn hairiness and clinging affect production yields, quality of final product, and housekeeping efforts. A major difficulty with high yarn hairiness is that clinging hair fibers between warp ends tend to prevent the formation of a clear front shed on the weaving machine.

A low yarn hairiness can be obtained in a spinner-bobbin of yarn by controlling traveler type and weight, condition of rings, and plumbing of spindles. Moreover it is desired to make uniform the degree of hairiness on a spindle-to-spindle basis, and to achieve a good average hairiness wherein the ratio of the high to the low is limited.

However, the development and commercial acceptance of air jet weaving in the late 1970's has increased the concern of weavers about the effect of hair fibers that protrude from the surface of short staple spun yarns. Indeed, air jet weaving generally requires yarns of higher qualities than shuttle weaving to achieve high productivity. An unclear front shed may obstruct the flight of the filling yarn, resulting in a filling stop that was warp induced.

It is also known that winding a ring spun yarn causes significant increases in yarn hairiness, sometimes on the order of 100 to 500 per cent. Thus, at the winding stage for spun yarn, prior efforts to suppress or control hairiness in spinning are unfortunately largely negated. Heretofore, no practical method or apparatus was available to wind a ring spun yarn without causing a significant increase in measurable hairiness.

A number of prior efforts to lower ultimate sized yarn hairiness have been proposed, but without significant success. For example, efforts to modify the ring spinning machines were not successful in producing a yarn with better locking of the outermost fibers. In the past, however, it had been established that yarn spun from spaced double-creeled roving approached the desired surface properties, but such spinning is no longer widely practiced because of economic reasons. Experimental efforts focused on winding including gas singeing, mechanical cutting, and scraping but no such efforts provided the desired dramatic results.

It was also known that tension had a bearing on wound yarn hairiness in that higher winding tension generally resulted in lower wound yarn hairiness. It is believed that this phenomenon occurs because long hair fibers are stripped from the yarn surface when passing through highly-loaded tension discs, thus improving the overall surface characteristics.

Nevertheless, despite such efforts to improve the surface characteristics of spun yarn and in particular its hairiness at various stages of the yarn handling processes, only a limited success has been achieved. Thus, it is an overall objective of this invention to control the physical characteristics of spun yarn, and especially the hairiness of spun yarn especially after spinning and winding.

By way of further background, yarn hairiness is usually defined as fiber ends and fiber loops protruding above the yarn 10 surface, where fiber loops account for about two-thirds of the yarn hairiness and fiber ends account for the other third. A number of techniques are available for measuring yarn hairiness, although currently measurement by optical and photographic means are generally preferred. In a typical, well-accepted measuring system, the hairiness of the yarn is determined by counting the number of fibers extending beyond the apparent surface of the yarn, and displaying the count for a predetermined period of time to obtain an objective count of the hairiness of the yarn for a unit length of yarn.

It is thus an overall objective of this invention to improve the surface characteristics of spun yarn.

It is an additional objective of this invention to improve the surface characteristics of spun yarn by controlling yarn hairiness.

It is still another objective of this invention to improve yarn hairiness in spun yarn by using an air jet nozzle or air vortex produced by a nozzle.

It is another overall objective of this invention to improve the physical characteristics of the surface of spun yarn by passing the spun yarn through an air jet nozzle.

It is still another specific objective of this invention to improve the physical characteristics of the surface of spun yarn by passing the spun yarn through an air jet nozzle in a direction opposite to the yarn direction during spinning.

It is yet another objective of this invention to improve the physical characteristics of the surface of spun yarn by passing the spun yarn through an air jet nozzle and controlling the angle of exit from the nozzle.

It is yet another objective of this invention to remove dust, loose fiber, seed coat contamination, and other impurities in spun yarns by passing the spun yarn through an air jet nozzle or air vortex produced in a nozzle.

It is still another general objective of the invention to remove contamination from yarn during a winding process.

It is another objective of the invention to modify a yarn with a jet nozzle to improve contamination removal during winding.

These and other objectives and aims of the invention will become apparent from a written description of the invention which follows when taken in conjunction with the accompanying drawings.

BRIEF SUMMARY OF THE INVENTION

Directed to achieving the foregoing objects, are to overcoming the problems of the prior art, the invention in one of its aspects relates to altering the surface characteristics of spun yarn by moving compressed air in a direction perpendicular and opposite to yarn movement. In another aspect, the invention relates to a method of passing a length of spun yarn through an air jet nozzle, thus causing long fibers to wrap around the yarn surface. Surface contamination is also stripped away by the force of the applied airstream.

The invention in another aspect relates to a new use of a conventional Murata jet nozzle of the type having two zones, a first imparting a counterclockwise air vortex, the other imparting a clockwise air vortex, each having a vortex speed on the order of 300,000 revolutions per minute. By moving the yarn axially in a direction reverse from that normally used in the Murata Jet Spinner, in the N1 zone only at an input pressure of about 105–110 pounds per square inch, significantly low hairiness is achieved.

In still another aspect of the invention, the withdrawal angle of the yarn from the air jet nozzle is controlled to be approximately 30 degrees from the axis of the nozzle.

In addition to reducing the hairiness of the yarn, the air stream in the air jet nozzle significantly reduced and stripped pepper trash from the yarn surface, thus producing a cleaner yarn as well as a less hairy yarn.

Thus, an overall objective of this invention is to wind ring spun yarn without causing major hairiness increases in addition to removal of impurities.

DETAILED DESCRIPTION OF THE PREFERRED EMBODIMENT

Figure 1:
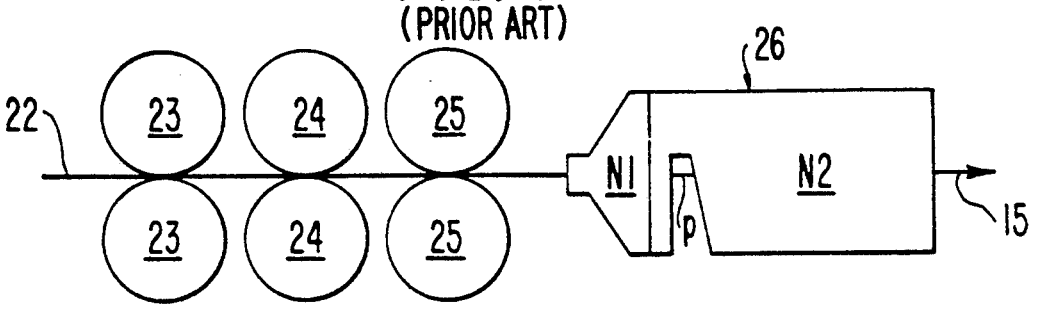
FIG. 1 (PRIOR ART)
FIG. 1 is a diagrammatic representation of a prior art air jet spinning system which uses two air jet nozzles, suitable for practicing the invention and which formed the basis for experimental studies concerning the invention.

The main features of the invention were confirmed using a conventional air jet spinner currently available from Murata Kikai K.K. in Japan. A Murata Model 802 air jet spinner was available, a portion of which is shown in FIG 1. There, diagrammatically, spun yarn is manufactured from a sliver 22 drafted to a desired thickness by back rollers 23, middle rollers 24, and front rollers 25 to be introduced as a staple fiber bundle through a nozzle 26 having a first fluid swirling nozzle N 1 and a second fluid swirling nozzle N2 to be converted into a spun yarn 15 drawn out by a delivery roller assembly and wound up by a winding unit (not shown). The reference letter p designates the air exhaust port between N1 and N2. Reference may be made to U.S. Pat. No. 4,497,167 for the details of such a unit, and the disclosure of that document is incorporated by reference to simplify a discussion of the available equipment used to verify the advantages of the invention.

As seen in FIG. 1, the nozzle 26 has two zones N1, N2. When spinning yarn as intended with the equipment, the nozzle N1 imparts a counterclockwise air vortex when viewed from downstream of the yarn 15, while the nozzle N2 imparts a clockwise air vortex. In this equipment, the air vortex is approximately 300,000 revolutions per minute, as established by the manufacturer. For purposes of verifying the features of the invention, the test winding machinery was run under a constant yarn tension of 35 grams at 900 meters per minute speed.

Figure 2:
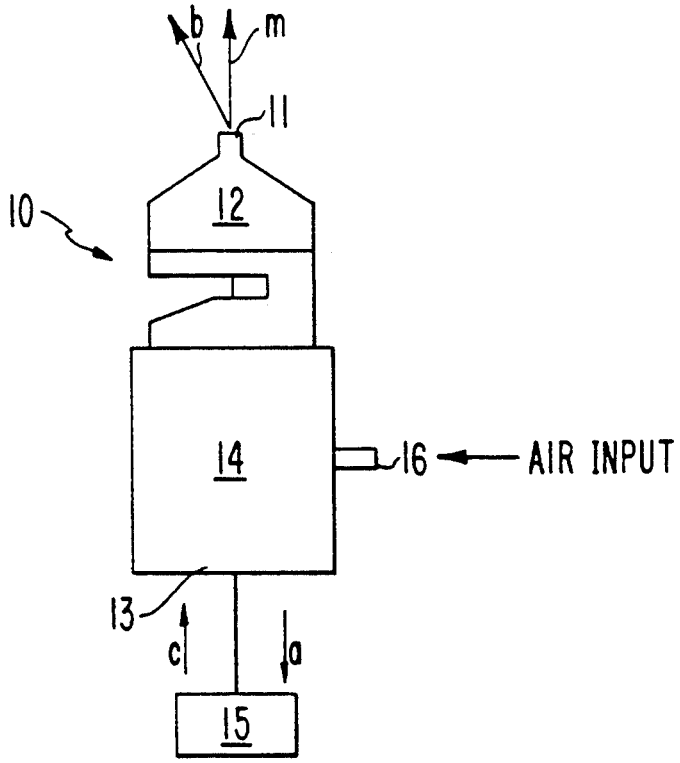
FIG. 2 is a diagrammatic representation of the method and apparatus of the invention using a conventional air jet nozzle.

In FIG. 2, the invention is illustrated diagrammatically and denoted by the reference numeral 10. Such a nozzle generally has a fleece separator zone 12, a housing 14 incorporating a nozzle, and a compressed air input 16. For normal operation as an air jet nozzle, the yarn passes through the nozzle in the direction of the arrow denoted by the reference letter a. Thus, when operating as an air jet nozzle, yarn passes from a front roller to a normal inlet 11 of the nozzle 10, through the fleece separator zone 12, past a twist point located in the nozzle, and to a normal outlet 13.

In accordance with the invention, spun yarn designated generally by the reference numeral 15 is provided to the nozzle 10 wherein its hairiness is reduced over normally wound spun yarn. Preferably, the spun yarn 15 is provided to the normal outlet 13 acting as an inlet for the spun yarn, and passes through the nozzle 10 in direction of the arrow designated by reference letter c opposite to that of normal operation, to exit from the nozzle 10 at the normal inlet 11. According to the invention, the angle of the exiting spun yarn is controlled relative to the axis of the nozzle 10, preferably to about 30 degrees, as indicated by reference letter b.

While the foregoing indicates the preferred embodiment of the invention conceptually, it is not believed necessary to pass the yarn in a reverse direction through the air jet nozzle if the twist direction of the spun yarn is opposite to the conventional right hand twist.

When using the equipment noted in FIG. 2, experimental variables were: (1) the direction of yarn movement through the nozzle, either in a normal direction, as shown in FIG. 1, or in a reversed direction, as indicated by the arrow m in FIG. 2; (2) the nozzle segment used, i.e. either N1 and N2 in combination, or N1 alone, or N2 alone; and (3) input air pressure. These parameters are summarized in Table 1 for the plot of data shown in FIG. 3 and in Table 2 for the plot of data shown in FIG. 4.

TABLE 1

Figure 3:
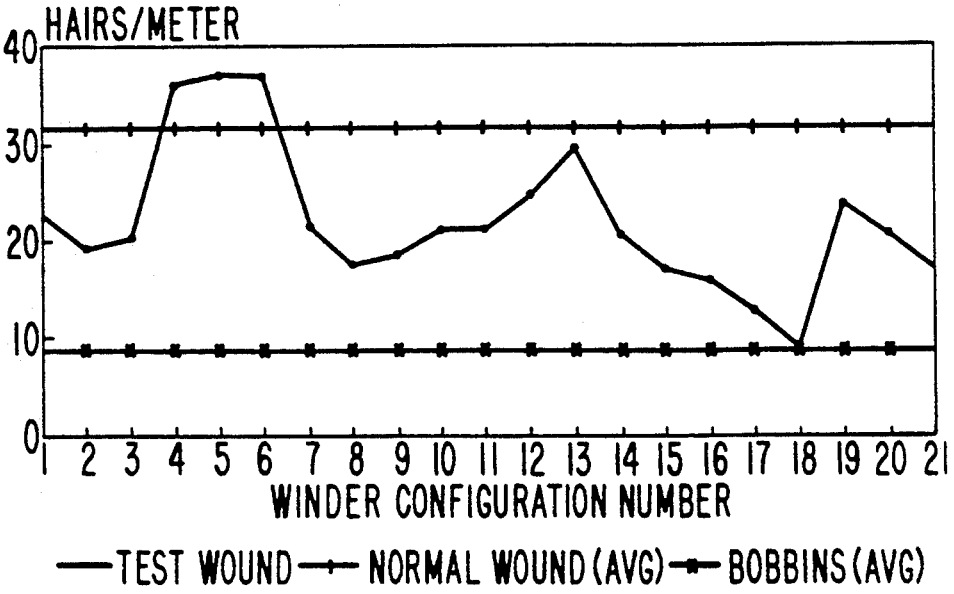
FIG. 3 is a graph of hairs per meter for various winder configurations, showing the changes in hairiness according to the invention for a 35/1 combed cotton application.

TEST DATA FOR 35/1 COMBED COTTON
(Corresponds to FIG. 3.)

| CONFIGURATION NUMBER | YARN DIRECTION | NOZZLE USED | PRESSURE (psi) | HAIRS PER METER OF YARN |
|---|---|---|---|---|
| 1 | Normal | N1N2 | 20 | 22.63 |
| 2 | Normal | N1N2 | 40 | 19.05 |
| 3 | Normal | N1N2 | 60 | 19.95 |
| 4 | Normal | N1 | 20 | 35.82 |
| 5 | Normal | N1 | 40 | 36.8 |
| 6 | Normal | N1 | 60 | 36.77 |
| 7 | Normal | N2 | 20 | 21.28 |
| 8 | Normal | N2 | 40 | 17.1 |
| 9 | Normal | N2 | 60 | 18.1 |
| 10 | Reverse | N1N2 | 20 | 20.85 |
| 11 | Reverse | N1N2 | 40 | 20.85 |
| 12 | Reverse | N1N2 | 60 | 24.35 |
| 13 | Reverse | N1 | 20 | 29.33 |
| 14 | Reverse | N1 | 40 | 20.4 |
| 15 | Reverse | N1 | 60 | 16.71 |
| 16 | Reverse | N1 | 80 | 15.54 |
| 17 | Reverse | N1 | 100 | 12.37 |
| 18 | Reverse | N1 | 105 | 8.65 |
| 19 | Reverse | N2 | 20 | 23.54 |
| 20 | Reverse | N2 | 40 | 20.2 |
| 21 | Reverse | N2 | 60 | 16.72 |

TABLE 2

Figure 4:
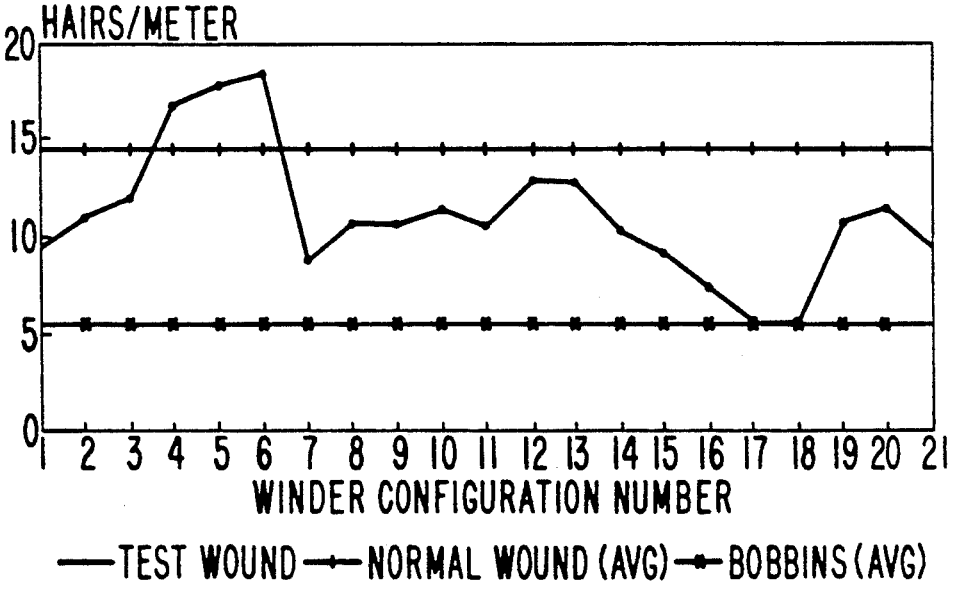
FIG. 4 is a graph of hairs per meter for various winder configurations, similar to FIG. 3, showing the changes in hairiness according to the invention for a 35/1 50/50 polyester-cotton mixture.

TEST DATA FOR 35/1 50/50 POLYESTER/COTTON
(Corresponds to FIG. 4.)

| CONFIGURATION NUMBER | YARN DIRECTION | NOZZLE USED | PRESSURE (psi) | HAIRS PER METER OF YARN |
|---|---|---|---|---|
| 1 | Normal | N1N2 | 20 | 9.47 |
| 2 | Normal | N1N2 | 40 | 10.91 |
| 3 | Normal | N1N2 | 60 | 11.85 |
| 4 | Normal | N1 | 20 | 16.7 |
| 5 | Normal | N1 | 40 | 17.71 |
| 6 | Normal | N1 | 60 | 18.44 |
| 7 | Normal | N2 | 20 | 8.68 |
| 8 | Normal | N2 | 40 | 10.78 |
| 9 | Normal | N2 | 60 | 10.53 |
| 10 | Reverse | N1N2 | 20 | 11.36 |
| 11 | Reverse | N1N2 | 40 | 10.44 |
| 12 | Reverse | N1N2 | 60 | 12.81 |
| 13 | Reverse | N1 | 20 | 12.66 |
| 14 | Reverse | N1 | 40 | 10.18 |
| 15 | Reverse | N1 | 60 | 9.19 |
| 16 | Reverse | N1 | 80 | 7.25 |
| 17 | Reverse | N1 | 100 | 5.62 |
| 18 | Reverse | N1 | 105 | 5.58 |
| 19 | Reverse | N2 | 20 | 10.72 |
| 20 | Reverse | N2 | 40 | 11.31 |
| 21 | Reverse | N2 | 60 | 9.46 |

All yarn hairiness testing described herein was executed on the bench model unit from Shirley Developments Ltd. of Stockport, England. The test unit was set to detect hair fibers that protruded at least 3 mm beyond the yarn surface.

The data plotted in FIG. 3 relate to 35/1 combed cotton. Of the 21 test conditions noted in Table 1, 18 conditions showed reduced hairiness of the test wound yarn compared to the normal wound yarn. When comparing bobbins and wound yarn, condition 18 has a very nearly equal hairiness in hairs/meter at 105 psi for a reverse yarn direction through nozzle N1.

Similarly, the data plotted in FIG. 4 relate to 35/1 50/50 polyester/cotton (PC) yarn wound at 900 ypm at a tension of 35 grams. Note that in the normal condition, the bobbin hairiness for a 300 m. sample was 4.81, while the wound yarn hairiness for a 200 m. sample was 14.88. Of the 21 conditions plotted in FIG. 4, 18 showed reduced hairiness of the test wound yarn compared to the normal wound yarn. Indeed, condition 18 shows a very nearly equal hairiness in hairs/meter at 105 psi for a reverse yarn direction through nozzle N1.

Randomly selected yarns were also wound using the Murata air jet nozzle with similarly dramatic results. In each case, the yarn wound with the Murata jet nozzle showed reduced hairiness over the wound yarn for 31/1 carded cotton; 48.5/1 65/35 PC; 31/1 carded cotton; 35/1 combed cotton; and 15/1 polyester/rayon for various representative conditions.

Figure 5:
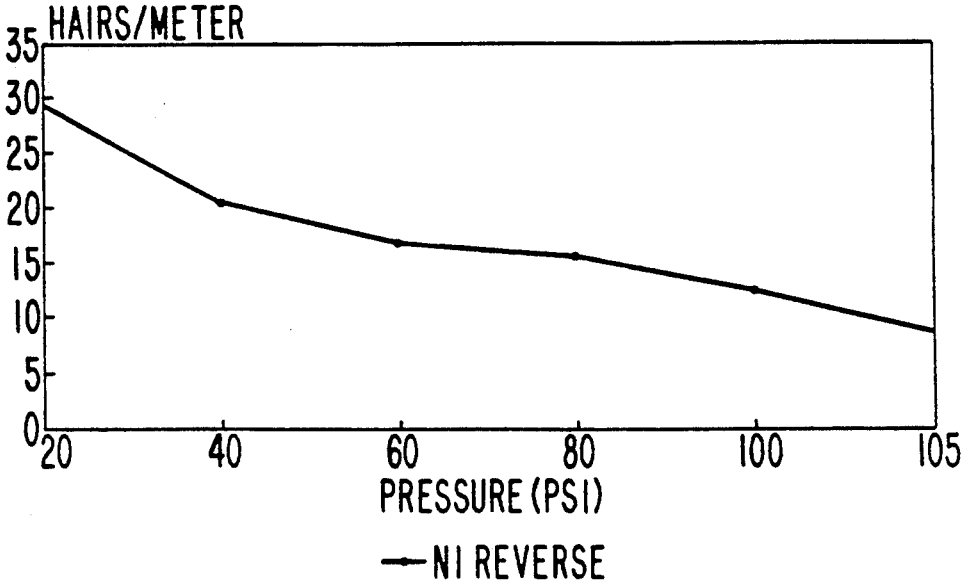
FIG. 5 is a plot of hairs per meter as a function of pressure for the yarn in FIG. 3.
Figure 6:
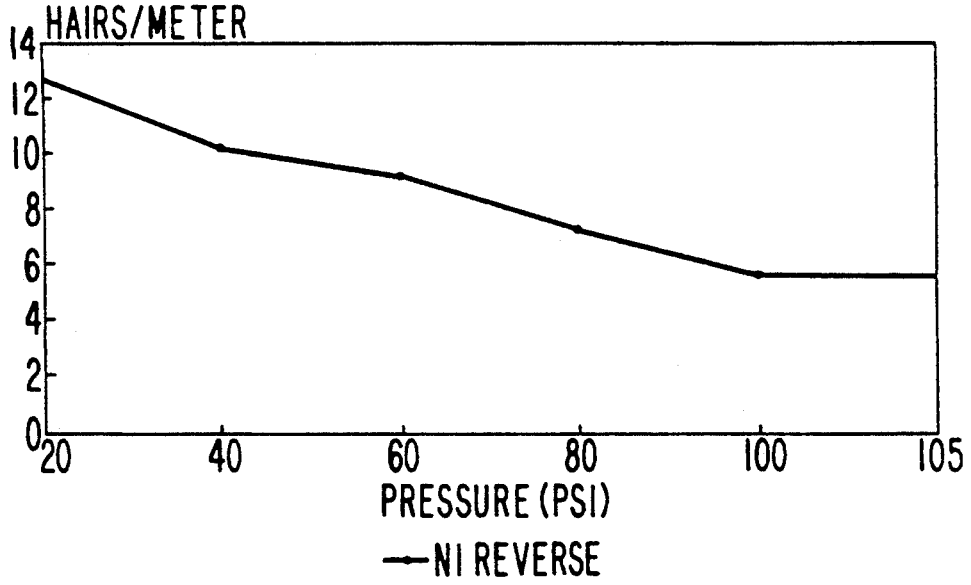
FIG. 6 is a plot of hairs per meter as a function of pressure for the yarn of FIG. 4.

FIGS. 5 and 6 show hairiness reduction as a function of pressure for reverse yarn passage through nozzle N1 for the yarns of FIGS. 3 and 4. These data preliminarily indicate an improved result for higher pressures.

Figure 7:
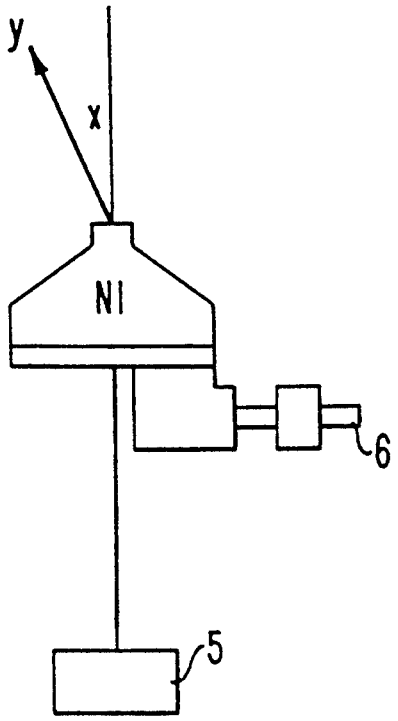
FIG. 7 is a diagrammatic representation of a modified air jet nozzle as previously shown in FIG. 1.

FIG. 7 concerns what we have called "revised N1". Revised N1 is simply the N1 nozzle portion removed from the N2 nozzle portion.

Revised N1 was constructed with the objective of allowing a larger volume of air to contact the yarn, thereby allowing improved removal of contamination (Volumetric air flow through N1 is increased when N1 is separated from N2).

In FIG. 7,

5=supply yarn

6=compressed air inlet y=direction of yarn withdrawal x=angle of yarn withdrawal relative to N1 axis In addition to the reduction in the yarn hairiness demonstrated by the test data indicated above, it was observed that the air stream in the N1 nozzle stripped away pepper trash from the yarn surface. Therefore, the wound yarn was significantly cleaner and less hairy and those results were apparent regardless of yarn count or blend.

Figure 8:
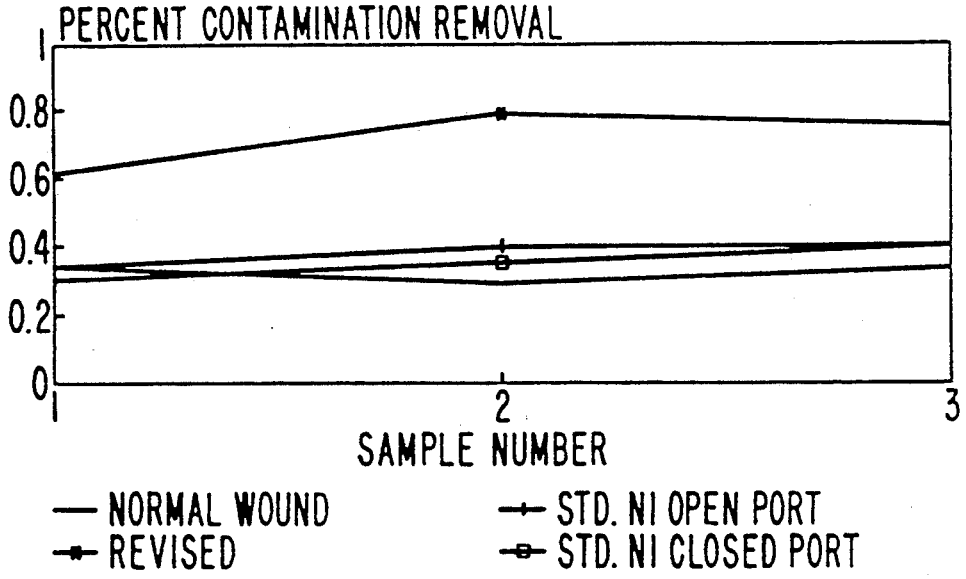
FIG. 8 is a plot showing improved contaminant removal.

Reference is made to FIG. 8 for showing a plot of trash removal effectiveness for the revised N1 approach relative to normal wound techniques or techniques involving an N1 nozzle using a standard open or closed port relative to 20/1 65/35 PC yarn. The present contamination removal brought about by the methods of the present invention indicate the superior cleaning ability when using the present invention.

The foregoing description of the invention demonstrates that the surface characteristics of spun yarn, and especially the hairiness of spun yarns can be markedly reduced over that of similar wound spun yarn by passing the spun yarn through an air jet nozzle. The foregoing also demonstrates a new use for existing apparatus in altering surface characteristics of spun yarn using an air jet nozzle. With the N1 nozzle configured specifically for trash removal cleaning is roughly twice that of normal winding or any other nozzle configuration.

For example, although the experimentation described herein utilizes an existing Murata air jet nozzle, it is not to be implied that other nozzles would not produce the same or even better effects in the final yarn.

While this invention has been described in conjunction with a specific apparatus, it is apparent that the invention encompasses many alternatives, modifications and variations which will be apparent to those skilled in the art. Accordingly, it is intended to embrace all alternatives, modifications and variation that fall within the scope of the appended claims.

What is claimed is:

1. A method comprising:

providing a length of a spun yarn;

supplying a rotating vortex having a translational velocity component moving in a first direction generally along the axis of rotation of said vortex;

passing said spun yarn through said vortex in a second direction generally opposite to said first direction and further wherein, when viewed facing said first direction, the twist in said spun yarn is generally opposite to the rotation of said vortex and exiting said spun yarn from said nozzle at an exit angle relative to the axis of said nozzle of approximately 30 degrees.

2. A method of reducing hairiness in a pre-existing textile spun yarn comprising the steps of:

(a) continuously moving a pre-existing textile spun yarn strand in a desired path, (b) passing the yarn strand along a portion of the path through a rotating vortex of fluid having a translational velocity component moving in a direction along the axis of rotation of the vortex generally opposite the direction of movement of the spun yarn strand therethrough and a translational velocity component opposite the direction of twist in the yarn strand, and

3. A method as defined in claim 2 wherein the vortex of fluid is created by passing pressurized air into an air jet nozzle having a central longitudinal passage through which the spun yarn strand passes, and wherein the step of concentrating the false twist in the yarn strand in the vortex is accomplished by engaging the yarn strand at the exit end of the air jet nozzle with a surface which opposes passage of false twist.

4. A method as defined in claim 3 wherein the false twist passage-opposing surface is an edge portion of the air jet nozzle and the yarn strand is engaged therewith to exit the nozzle at an angle to the central longitudinal axis of the air jet nozzle.

5. A method as defined in claim 4 wherein the angle is up to 30°.

6. A method as defined in claim 3 wherein the vortex of fluid is air and the air is passed into the air jet nozzle at an input air pressure of at least about 20 psi.

7. A method of reducing hairiness in a pre-existing textile spun yarn comprising the steps of:

(a) providing a pre-existing textile spun yarn strand from a spun yarn storage, (b) directing the spun yarn strand in a desired path of travel, (c) passing the spun yarn strand along a portion of the path through a rotating vortex of fluid having a translational velocity component moving in a direction along the axis of rotation of the vortex generally opposite the direction of movement of the spun yarn strand therethrough and a translational velocity component opposite the direction of twist in the spun yarn strand, and (d) contacting the moving spun yarn strand immediately adjacent its exit from the vortex of fluid with a surface which opposes passage of false twist to concentrate false twist in the spun yarn stand in the vortex.

8. A method as defined in claim 7 wherein the vortex of fluid is created by passing pressurized air into an air jet nozzle having a central longitudinal passage through which the spun yarn strand passes, and wherein the step of concentrating the false twist in the yarn strand in the vortex is accomplished by engaging the yarn with an edge surface of the air jet nozzle so as to exit the nozzle at an angle to the central longitudinal axis of the air jet nozzle.

9. A method as defined in claim 8 wherein the angle is up to 30°.

10. A method as defined in claim 8 wherein the vortex of fluid is air and the air is passed into the air jet nozzle at an input air pressure of at least about 20° psi.

* * * * *

UNITED STATES PATENT AND TRADEMARK OFFICE

CERTIFICATE OF CORRECTION

PATENT NO. : 5,263,311

DATED : November 23, 1993

INVENTOR(S) : Ralph W. Feil and Thomas M. Ellis

It is certified that error appears in the above-identified patent and that said Letters Patent is hereby corrected as shown below:

On title page, item [75] "Thomas M. Ellis, Earlysville, both of Va." should read:

Thomas M. Ellis, Spartanburg, both of S.C.

In column 3, line 3, change "are" to --and--.

In Claim 2, column 7, line 25, after the word "and", add the following subparagraph:

--(c) concentrating false twist in the yarn strand in the vortex.--

In column 8, line 38, change "20° psi" to:

--20 psi--

Signed and Sealed this

Twelfth Day of April, 1994

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,263,311

DATED : November 23, 1993

INVENTOR(S) : Ralph W. Feil and Thomas M. Ellis

It is certified that error appears in the above-indentified patent and that said Letters Patent is hereby corrected as shown below:

On the title page, item [75] "Thomas M. Ellis, Earlysville, V." should read:

--Thomas M. Ellis, Spartanburg, S.C.--.

In column 3, line 3, change "are" to --and--.

In Calim 2, column 7, line 25, after the word "and", add the following subparagraph:

--(c) concentrating false twist in the yarn strand in the vortex.--.

In column 8, line 38, change "20° psi" to:

--20 psi--.

This certificate supersedes the Certificate of Correction issued April 12, 1994.

Signed and Sealed this

Thirtieth Day of August, 1994

*Attest:*

*Attesting Officer*

Bruce Lehman

BRUCE LEHMAN

*Commissioner of Patents and Trademarks*

UNITED STATES PATENT AND TRADEMARK OFFICE

CERTIFICATE OF CORRECTION

PATENT NO. : 5,263,311

DATED : November 23, 1993

INVENTOR(S) : Ralph W. Feil, et al

It is certified that error appears in the above-indentified patent and that said Letters Patent is hereby corrected as shown below:

On the title page, item [75] "Thomas M. Ellis, Earlysville, VA." should read:

—Thomas M. Ellis, Spartanburg, S.C.—.

In column 3, line 3, change "are" to —and—.

In claim 2, column 7, line 25, after the word "and", add the following subparagraph:

—(c) concentrating false twist in the yarn strand in the vortex.—.

In column 8, line 38, change "20° psi" to:

—20 psi—.

This certificate supersedes Certificate of Correction issued April 12, 1994 and August 30, 1994.

Signed and Sealed this

Fourteenth Day of March, 1995

*Attest:*

*Attesting Officer*

Bruce Lehman

BRUCE LEHMAN

*Commissioner of Patents and Trademarks*